US008528173B2

(12) United States Patent
Sterner et al.

(10) Patent No.: US 8,528,173 B2
(45) Date of Patent: Sep. 10, 2013

(54) SHOCKPROOF, QUICK-ACTION CLOSURE FOR AN END FITTING

(75) Inventors: Jonas Sterner, Alingsas (SE); Gôran Carlsson, Vargarda (SE); Robert Svensson, Fristad (SE)

(73) Assignee: Autoliv Development AB, Vargarda (SE)

( * ) Notice: Subject to any disclaimer, the term of this patent is extended or adjusted under 35 U.S.C. 154(b) by 254 days.

(21) Appl. No.: 12/812,972

(22) PCT Filed: Jan. 7, 2009

(86) PCT No.: PCT/EP2009/000023

§ 371 (c)(1), (2), (4) Date: Jul. 15, 2010

(87) PCT Pub. No.: WO2009/090002

PCT Pub. Date: Jul. 23, 2009

(65) Prior Publication Data

US 2011/0041298 A1 Feb. 24, 2011

(30) Foreign Application Priority Data

Jan. 15, 2008 (DE) ..... 10 2008 004 338

(51) Int. Cl.
*A44B 11/25* (2006.01)

(52) U.S. Cl.
USPC ..... 24/633; 24/629; 24/645

(58) Field of Classification Search
USPC ..... 24/704.1, 704.2, 579.11, 628, 629, 24/633, 640, 652, 456, 645
See application file for complete search history.

(56) References Cited

U.S. PATENT DOCUMENTS

| | | | | |
|---|---|---|---|---|
| 2,067,792 | A * | 1/1937 | Seaman | 335/46 |
| 5,566,431 | A * | 10/1996 | Haglund | 24/633 |
| 5,595,400 | A | 1/1997 | Wier | |

(Continued)

FOREIGN PATENT DOCUMENTS

| | | | |
|---|---|---|---|
| DE | 92 02 527.7 | U1 | 5/1992 |
| DE | 102 45 818 | A1 | 4/2003 |
| EP | 0 507 266 | B1 | 6/1995 |
| EP | 1 266 587 | B1 | 10/2007 |

OTHER PUBLICATIONS

PCT/EP2009/00023—International Search Report—May 19, 2009.

*Primary Examiner* — Robert J Sandy
*Assistant Examiner* — Abigail E Morrell
(74) *Attorney, Agent, or Firm* — Brinks Hofer Gilson & Lione

(57) ABSTRACT

A quick-action closure for the end fitting of a safety belt, whereby the quick-action closure includes an insertion tongue which can be inserted into a closure housing and which can be locked therein by means of a locking element disposed in a mobile manner between a locking position and a release position, and whereby the locking element can be transferred from its locking position into its release position by means of an actuating element which can be inserted into the closure housing. A safety element (21) is disposed in the closure housing (11) mounted at its center of gravity (35) rotatable between a safety position and a rest position, the safety element in its safety position fixing the locking element (20) in its locking position and, in its rest position, releasing the locking element (20), whereby the safety element (21) is held in its safety position by the action of a spring (25).

16 Claims, 2 Drawing Sheets

(56) References Cited

U.S. PATENT DOCUMENTS

| | | | | |
|---|---|---|---|---|
| 5,598,613 | A * | 2/1997 | Feile et al. | 24/641 |
| 6,367,129 | B1 * | 4/2002 | Mori | 24/641 |
| 6,550,112 | B2 * | 4/2003 | Rohrle et al. | 24/641 |
| 6,588,077 | B2 * | 7/2003 | Katsuyama et al. | 24/641 |
| 6,895,643 | B2 * | 5/2005 | Itoigawa et al. | 24/633 |
| 7,124,480 | B2 * | 10/2006 | Kawai et al. | 24/633 |
| 7,155,785 | B2 * | 1/2007 | Muromachi | 24/641 |
| 7,370,393 | B2 * | 5/2008 | Hlavaty et al. | 24/633 |
| 7,538,283 | B2 * | 5/2009 | Muromachi | 200/61.58 B |
| 7,543,363 | B2 * | 6/2009 | Webber et al. | 24/641 |
| 2002/0092141 | A1 * | 7/2002 | Rohrle et al. | 24/641 |
| 2002/0178557 | A1 * | 12/2002 | Katsuyama et al. | 24/633 |
| 2003/0101553 | A1 * | 6/2003 | Itoigawa et al. | 24/633 |
| 2004/0111846 | A1 * | 6/2004 | Itoigawa et al. | 24/633 |
| 2005/0086777 | A1 * | 4/2005 | Kawai et al. | 24/633 |
| 2006/0059667 | A1 * | 3/2006 | Hlavaty et al. | 24/633 |
| 2006/0261588 | A1 * | 11/2006 | Kohama | 280/801.1 |
| 2007/0001047 | A1 | 1/2007 | Yasuda et al. | |

* cited by examiner

SHOCKPROOF, QUICK-ACTION CLOSURE FOR AN END FITTING

CROSS REFERENCE TO RELATED APPLICATION

This application claims priority to German Patent Application No. 10 2008 004 338.9, filed Jan. 15, 2008 and PCT patent application PCT/EP2009/000023, filed Jan. 7, 2009.

FIELD OF THE INVENTION

The invention relates to a quick-action closure for an end fitting of a safety belt, whereby the quick-action closure comprises an insertion tongue which can be inserted into a closure housing and which can be locked therein by means of a locking element disposed in a mobile manner between a locking position and a release position, and whereby the locking element can be transferred from its locking position into its release position by means of an actuating element which can be inserted into the closure housing.

BACKGROUND OF THE INVENTION

A quick-action closure with the aforementioned features is described in DE 102 45 818 A1. Such a quick-action closure is concerned with creating the possibility of bringing the locking element for the insertion tongue into the release position by means of an actuating tool, which can be applied to the quick-action closure, and thus releasing the quick-action closure in a straightforward and reliable manner. Especially if such a quick-action closure is used with an end-fitting tightener, there is the requirement for the quick-action closure to be designed shockproof in the direction of movement corresponding to its longitudinal direction.

With the known quick-action closure, the locking element comprises two symmetrically constructed tong elements, which are mobile at right angles to the insertion direction of the insertion tongue and, in the locking position, engage laterally behind a widened head of the insertion tongue. The tong elements are subject to the action of a spring which constantly pretensions them into the locking position. Due to their symmetrical arrangement, the tong elements in fact act in an acceleration-neutral manner, but with the known quick-action closure there is still the drawback that, both during the insertion of the insertion tongue and during the pushing-apart of the tong elements by means of the applied actuating element, the action of the spring must in both cases be overcome, but for safety reasons the latter must be designed suitably strong in order that a reliable fixing of the insertion tongue in the closure housing is guaranteed.

The problem underlying the invention is to make available a quick-action closure with the generic features, which on the one hand enables easy insertion and removal of the insertion tongue, but at the same time is designed shockproof.

The solution to this problem, including advantageous configurations and developments of the invention, emerges from the contents of the claims which follow this description.

SUMMARY OF THE INVENTION

In its basic idea, the invention makes provision such that a safety element is disposed in the closure housing mounted at its center of gravity rotatable between a safety position and a rest position, said safety element in its safety position fixing the locking element in its locking position and, in its rest position, releasing the locking element, whereby the safety element is held in its safety position by the action of a spring. For the fixing of the locking element in its locking position and for the simultaneous shockproofing of the quick-action closure, the safety element according to the invention is provided which is rotatable about an axis of rotation corresponding to its center of gravity. The safety element is not therefore subject to any turning moments when linear acceleration forces occur, so that the safety element remains, without its active movement, in its safety position, in which it is additionally secured by the spring action.

In order to exert the spring action, provision is made according to an example of embodiment of the invention such that the spring is designed as a torsion spring formed with two free ends, one end whereof extends into the path of movement of the insertion tongue and the other end whereof acts on the safety element, whereby provision can be made for the secure connection of the spring to the safety element such that the safety element comprises a channel for accommodating the assigned end of the torsion spring.

According to an example of embodiment of the invention, provision is made such that the spring is disposed in such a way that the spring tensioned by the insertion tongue, which is inserted and locked in the closure housing, holds the safety element in its safety position.

With regard to the release of the locking for the insertion tongue, provision is made according to an example of embodiment of the invention such that the safety element comprises, in addition to its retaining stop fixing the locking element in the safety position, an actuating stop for the actuating element introduced into the closure housing. In this regard, this is associated with the advantage that only the safety element has to be withdrawn from its safety position by the action of the actuating element, in order that the locking element, which is not subject to the spring action, is easily released.

For the formation of the actuating stop, provision can be made such that the rotatably disposed safety element is provided with a radial cutout disposed in such a way that the actuating stop can be acted upon in the safety position of the safety element by the actuating element, which can be inserted into the closure housing in the insertion direction of the insertion tongue.

In order that it is ensured, despite the provided cutout, that the center of gravity of the safety element coincides with its axis of rotation, provision is made such that the safety element is provided with a mass balance designed with respect to the radial cutout; such a mass balance can be created for example by another cutout correspondingly provided rotation-symmetrically.

According to an example of embodiment of the invention, provision can be made such that the closure housing is designed U-shaped with two housing plates laterally bounding the insertion path for the insertion tongue and a web connecting the housing plates, and that the insertion tongue, on its side facing away from the web, has a locking recess for the engagement of the locking element and, with its rear side lying opposite the locking recess, rests in the locking position against the web of the housing.

According to an example of embodiment of the invention, provision is made such that the actuating element is designed as a fork-shaped tool with two forks, one fork whereof is orientated towards the actuating stop of the safety element when the actuating element is inserted into the closure housing and the other fork whereof acts on the locking element in its direction of movement from the locking position into the release position. Provision can further be made such that the respective path of movement of the forks of the actuating element is disposed on different sides of the axis of rotation of the safety element and that the rotational directions of the movement of the safety element from its safety position into its rest position and of the locking element from its locking position into its release position are orientated in an opposing manner.

In detail, provision can further be made according to an example of embodiment of the invention such that the forks of the actuating element have a different length such that, when the actuating element is inserted into the closure housing, the one fork first acts on the actuating stop of the safety element and rotates the safety element into its rest position and then the other fork takes up the locking element and transfers it into its release position.

In order to incorporate a quick-action closure into a safety belt system, provision is made according to an example of embodiment of the invention such that the insertion tongue forms the end fitting connected to the belt band and that the closure housing is connected to a cable leading to the end-fitting tightener. Alternatively it can be provided that the closure housing is connected to a holder or to a belt strap.

According to embodiment of the invention it can be provided that the locking element is disposed with its swiveling mobility around an axis which is arranged perpendicular to the lateral housing plates of the closure housing. According to an embodiment of the invention herewith it can be associated that the locking element is disposed with its swiveling mobility in the longitudinal direction of the closure in a plane parallel to the lateral housing plates of the closure housing.

It can be provided that the center of gravity of a mass being formed from the safety element and the spring is arranged within the center of rotation of the safety element.

BRIEF DESCRIPTION OF THE DRAWINGS

An example of embodiment of the invention is reproduced in the drawing and is described below. In the figures.

DETAILED DESCRIPTION OF THE INVENTION

Figure 1:
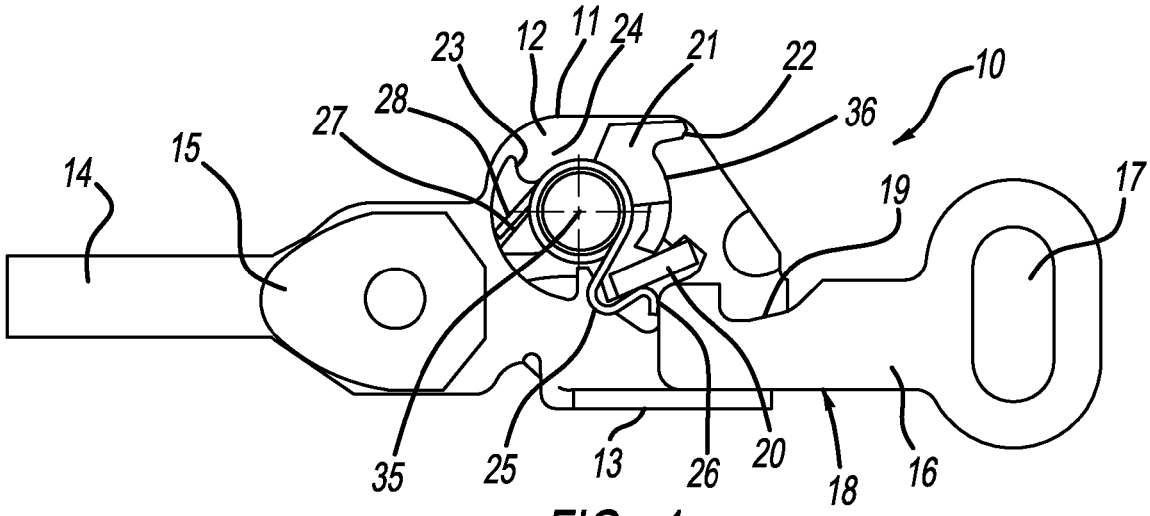
FIG. 1 shows a quick-action closure in a schematic side view at the start of the insertion of the insertion tongue into the closure housing.

As first emerges from FIG. 1, quick-action closure 10 comprises a U-shaped closure housing 11, lateral housing plates 12 whereof are connected via a web 13 and form between them the insertion path for an insertion tongue 16. At its one (left-hand) end, closure housing 11 is connected via a fastening fitting 15 to a cable 14 preferably leading to an end-fitting tightener. Insertion tongue 16, which can be inserted from the other (right-hand) side into closure housing 11, has at its outer end an eyelet 17 for the connection of a safety belt band.

Figure 3:
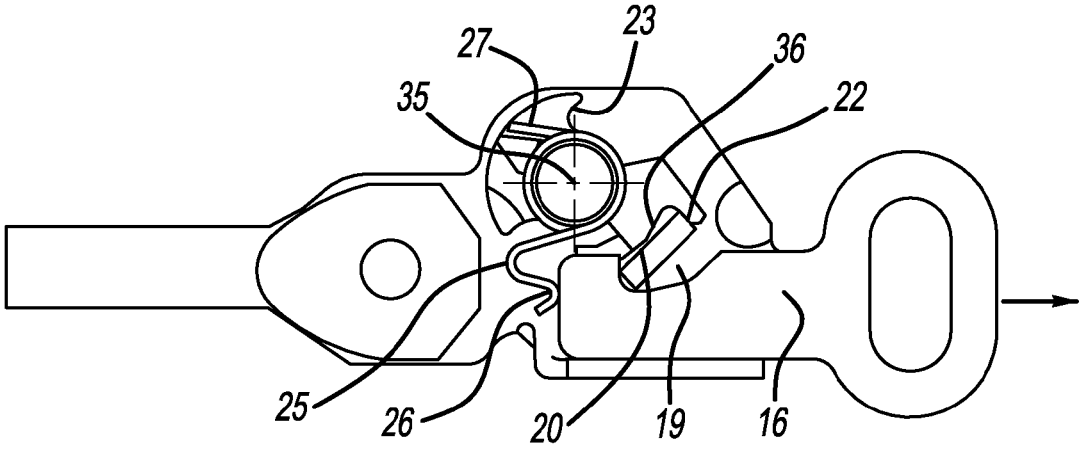
FIG. 3 shows the quick-action closure according to FIGS. 1 and 2 in the locking position of the insertion tongue.

Lying opposite rear side 18 of insertion tongue 16 which slides over web 13 when insertion tongue 16 is inserted into closure housing 11, there is disposed on insertion tongue 16 a locking recess 19, into which a plate-shaped locking element 20 mounted in a swiveling manner in closure housing 11 can be swiveled, whereby locking element 20 is swiveled in the counter-clockwise direction out of the release position shown in FIG. 1, so that—as shown in FIG. 3—the (right-hand) end of plate-shaped locking element 20 facing insertion tongue 16 is raised and at the same time the other (left-hand) end dips into locking recess 19 of insertion tongue 16 and locks the latter.

Figure 2:
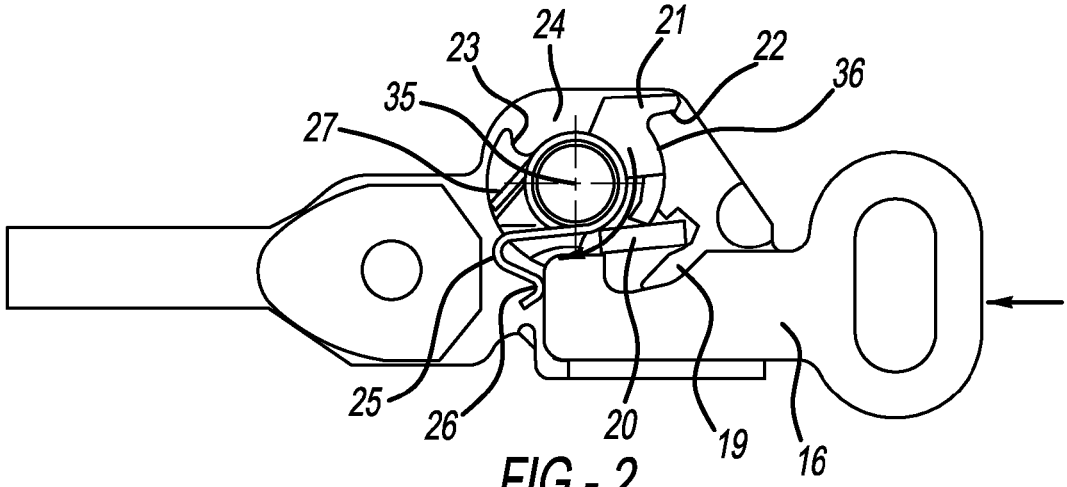
FIG. 2 shows the quick-action closure according to FIG. 1 shortly before the locking position of the insertion tongue is reached.
Figure 4:
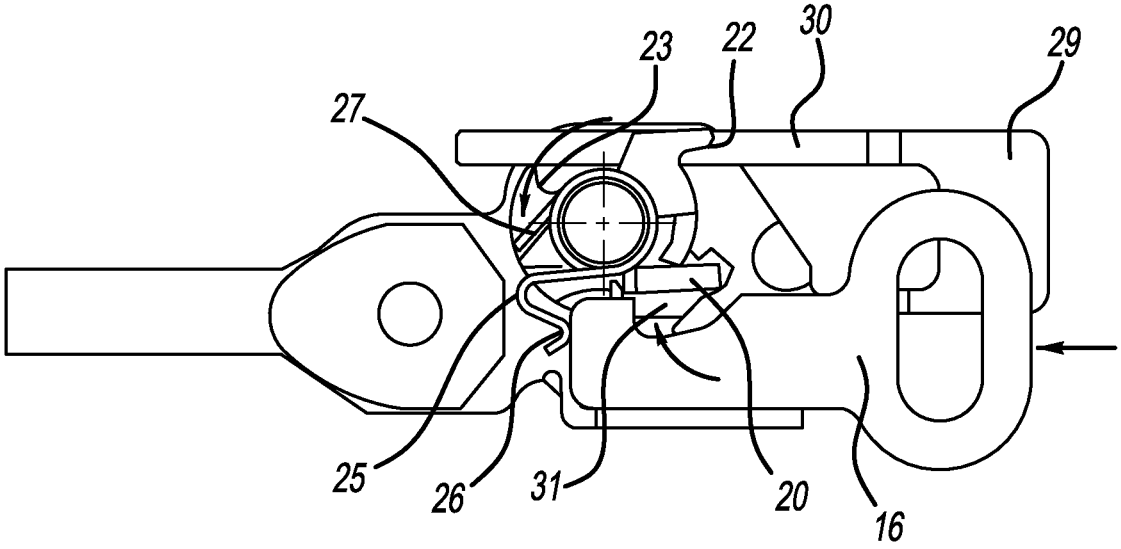
FIG. 4 shows the quick-action closure according to FIGS. 1 to 3, during the opening process initiated by means of an actuating element inserted into the closure housing.

For the fixing of locking element 20 in its locking position and for the simultaneous shockproofing of quick-action closure 10 against acceleration forces occurring in the longitudinal direction of the closure, a safety element 21 is mounted rotatably in the closure housing 11, whereby center of gravity 35 of a mass which is formed by the safety element 21 and of a spring 25 to be described later on at the same time forms the point of rotation for the rotation of safety element 21 between the rest position which can be seen from FIG. 1 and FIG. 2 and the safety position which can be seen in FIG. 3. But it can be sufficient if only the center of gravity 35 of the safety element 21 is incorporated into the definition for the center of rotation for the rotation of the safety element 21. Safety element 21 has a retaining stop 22, with which it engages over and locks plate-shaped locking element 20 in its locking position. By providing a cutout 24, there is also formed on safety element 21 an actuating stop 23, which in the safety position of safety element 21 (FIG. 3) extends into a channel, which runs parallel to insertion tongue 16 and into which a tool-like actuating element 29 can be inserted to release safety element 21 (FIG. 4).

Also disposed in the closure housing 11 is a spring 25 in the form of a torsion spring with two free ends 26 and 27, one cranked end 26 of spring 25 extending into the path of movement of insertion tongue 16, so that spring end 26 is acted on by insertion tongue 16. Other end 27 of spring 25 is pushed into a channel 28 formed on safety element 21, so that a direct coupling of spring end 27 with safety element 21 results.

As shown in FIG. 1, insertion tongue 16 is pushed into closure housing 11 in order to couple together a safety belt system described for example in generic DE 10245818 A1. Insertion tongue 16 with its front end comes to rest here against end 26 of spring 25 and thus tensions spring 25. At the same time, the front, beveled edge of insertion tongue 16 raises plate-shaped locking element 20 at its inner edge. As soon as this inner edge has reached locking recess 19 formed in insertion tongue 16, locking element 20 on the one hand swivels into locking recess 19, whereby at the same time spring 25 tensioned by the insertion movement of insertion tongue 16 into closure housing 11 rotates, via spring end 27, safety element 21 in the clockwise direction. A surface 36 is disposed on safety element 21, such that, as a result of the rotation of safety element 21, the swiveling motion of locking element 20 into its locking position is guided in locking recess 19. At the end of the locking path, retaining stop 22 of safety element 21 and/or the surface 36 lies against locking element 20 and thus prevents a movement of locking element 20 into its release position. In this locking position, safety element 21 continues to be subject to the action of spring 25 tensioned by insertion tongue 16 (FIG. 3).

Since, according to the invention, the axis of rotation coincides in the case of safety element 21 with its center of mass 35, no turning moments occur in the presence of acceleration forces acting in the longitudinal direction on closure housing 11, so that an automatic movement of safety element 21, against the force of spring 25, is avoided and quick-action closure 10 is thus held in the locked state.

Figure 5:
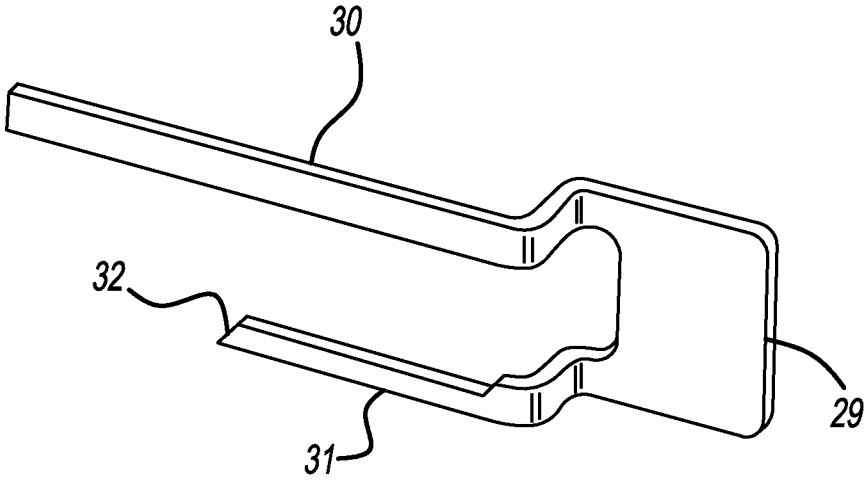
FIG. 5 shows the tool inserted according to FIG. 4 and used as an actuating element, in a detail representation.

If such a quick-action closure 10 is to be opened by means of an actuating element, actuating element 29 represented in FIG. 5 is provided, which is formed fork-shaped with an upper fork 30 and a lower fork 31; upper fork 30 has a greater axial length extension than lower fork 31. In addition, lower fork 31 is provided at its front end with a run-up bevel 32.

If actuating element 29 is pushed into closure housing 11 from the insertion side of insertion tongue 16, axially projecting upper fork 30 comes to rest first against actuating stop 23 of safety element 21, said actuating stop standing up in the safety position of safety element 21. With further pushing-in, safety element 21 is rotated counter-clockwise out of its safety position in the direction of its rest position, whereby, during this pushing-in of actuating element 29, lower fork 31 with run-up bevel 32 formed thereon comes into contact with locking element 20 standing obliquely to the insertion direction and raises the locking element in the clockwise direction out of locking recess 19 of insertion tongue 16. Following this, insertion tongue 16 together with actuating element 29 should be withdrawn from closure housing 11, this process being supported by tensioned spring 25, which is then for the most part relaxed and available for a renewed insertion process of insertion tongue 16.

In a further embodiment of the invention, provision is made such that the actuating element can also be applied to closure housing 11 laterally, i.e. at right angles to the plane defined by housing plates 12 of closure housing 11, whereby projections are provided on the actuating element in such a way that a rotation of the actuating element brings about both a rotation of safety element 21 out of its safety position (FIG. 3) in the direction of the rest position (1) as well as a tilting of locking element 20 between its locking position (FIG. 3) and its release position (FIG. 1).

The features of the subject-matter of these documents disclosed in the above description, the claims, the abstract and the drawing may be essential individually as well as in any combinations with one another for the implementation of the invention in its various embodiments.

The invention claimed is:

1. A quick-action closure for an end fitting of a safety belt, the quick-action closure comprising:

a closure housing, an insertion tongue configured for insertion into the closure housing along an insertion path, a locking element disposed in the closure housing and movable between a locking position and a release position, the locking element locking the insertion tongue in the closure housing when the locking element is in the locking position, a safety element mounted in the closure housing and rotatable about an axis of rotation between a safety position and a rest position, the safety element in the safety position fixing the locking element in the locking position and, in the rest position, releasing the locking element, the axis of rotation extending through a center of gravity of a safety element arrangement that includes at least the safety element, a spring urging the safety element toward the safety position, and an actuating element configured to be inserted into the closure housing, the actuating element being dimensioned to abut the locking element upon insertion of the actuating element into the closure housing and to move the locking element from the locking position to the release position.

2. The quick-action closure according to claim 1, wherein the spring is further tensioned by the insertion of the insertion tongue into the closure housing.

3. The quick-action closure according to claim 1, wherein the actuating element is dimensioned to engage the safety element upon insertion of the actuating element into the closure housing and to move the safety element from the safety position to the rest position and wherein the safety element has a retaining stop fixing the locking element in the safety position, and an actuating stop for the actuating element.

4. The quick-action closure according to claim 3, wherein the actuating stop has a radial cutout configured to be engaged by the actuating element.

5. The quick-action closure according to claim 4, wherein the safety element has a mass balance compensating for the radial cutout.

6. The quick-action closure according to claim 5, wherein the mass balance of the safety element is formed by a counter-cutout which is generally rotation-symmetric to the radial cutout in the safety element with respect to the axis of rotation.

7. The quick-action closure according to claim 3, wherein the actuating element is a fork-shaped tool with first and second forks, the first fork being oriented towards the actuating stop of the safety element when the actuating element is inserted into the closure housing and the second fork acting on the locking element in a direction from the locking position into the release position.

8. The quick-action closure according to claim 7, wherein a path of movement of the forks of the actuating element is disposed on different sides of the axis of rotation of the safety element and that the rotational directions of the movement of the safety element from the safety position into its rest position and of the locking element from the locking position into the release position are oriented in an opposing manner.

9. The quick-action closure according to claim 7, wherein the first and second forks of the actuating element have a different length such that, when the actuating element is inserted into the closure housing, the first fork first acts on the actuating stop of the safety element and rotates the safety element into the rest position and then the second fork takes up the locking element and transfers it into the release position.

10. The quick-action closure according to claim 1 wherein the closure housing is generally U-shaped with two housing plates laterally bounding the insertion path for the insertion tongue and a web connecting the housing plates, and that the insertion tongue, on its side facing away from the web, has a locking recess for the engagement of the locking element and, with its rear side lying opposite the locking recess, rests in the locking position against the web of the closure housing.

11. The quick-action closure according to claim 1, further comprising a safety belt and a cable configured to lead to an end-fitting tightener or to a holder or to a belt strap, wherein the insertion tongue forms the end fitting connected to the safety belt and wherein the closure housing is connected to the cable.

12. The quick-action closure according to claim 1, wherein the locking element is disposed with swiveling mobility about a swivel axis perpendicular to lateral housing plates of the closure housing.

13. The quick-action closure according to claim 1 wherein the locking element is disposed with swiveling mobility in a longitudinal direction of the closure in a plane parallel to lateral housing plates of the closure housing.

14. The quick-action closure according to claim 1, wherein the safety element arrangement further includes the spring.

15. A quick-action closure for an end fitting of a safety belt, the quick-action closure comprising:

a closure housing, an insertion tongue configured for insertion into the closure housing along an insertion path, a locking element disposed in the closure housing and movable between a locking position and a release position, the locking element locking the insertion tongue in the closure housing when the locking element is in the locking position, a safety element mounted in the closure housing and rotatable about an axis of rotation between a safety position and a rest position, the safety element in the safety position fixing the locking element in the locking position and, in the rest position, releasing the locking element, the axis of rotation extending through a center of gravity of a safety element arrangement that includes at least the safety element, a spring urging the safety element toward the safety position, and an actuating element configured to be inserted into the closure housing, the actuating element being dimensioned to engage the locking element upon insertion of the actuating element into the closure housing and to move the locking element from the locking position to the release position, wherein the spring is a torsion spring formed with first and second free ends, the first end extending into the insertion path of the insertion tongue and the second end acts on the safety element.

16. The quick-action closure according to claim 15, wherein the safety element comprises a channel for accommodating the second end of the torsion spring.

* * * * *